US005512931A

United States Patent [19]

Nakajima et al.

[11] Patent Number: 5,512,931

[45] Date of Patent: Apr. 30, 1996

[54] HEAT TRANSFER RECORDING PROCESS USING AN INTERMEDIATE RECORDING SHEET

[75] Inventors: Atsushi Nakajima; Shinji Matsumoto; Katsumi Maejima; Koichi Nakatani; Sota Kawakami; Ai Katsuda, All of Hino, Japan

[73] Assignee: Konica Corporation, Japan

[21] Appl. No.: 71,173

[22] Filed: Jun. 1, 1993

[30] Foreign Application Priority Data

| | | | |
|---|---|---|---|
| Jun. 3, 1992 | [JP] | Japan | 4-142801 |
| Jan. 7, 1993 | [JP] | Japan | 5-001235 |
| Mar. 4, 1993 | [JP] | Japan | 5-043859 |

[51] Int. Cl.[6] ..... B41J 2/32

[52] U.S. Cl. ..... 347/213; 347/217

[58] Field of Search ..... 346/76 R, 1.1, 346/135.1, 76 PH, 762; 400/120; 347/213

[56] References Cited

U.S. PATENT DOCUMENTS

| | | | |
|---|---|---|---|
| 5,263,781 | 11/1993 | Mima et al. | 400/120 |
| 5,332,459 | 7/1994 | Imai et al. | 156/234 |

*Primary Examiner*—Huan H. Tran
*Attorney, Agent, or Firm*—Jordan B. Bierman; Bierman and Muserlian

[57] ABSTRACT

A process for image forming by heat transfer method is disclosed. The process comprises the steps of (1) transferring an ink image from an ink layer of an ink sheet, which comprises a support and an ink layer provided on the support, to a surface of an intermediate image receiving layer of an intermediate image receiving sheet, which comprises a support and an image receiving layer provided on the support, by imagewise heating the ink layer, and (2) re-transferring the ink image transferred on the intermediate image receiving layer to a secondary image receiving sheet, In the above process, the ink layer comprises a coloring material and a homopolymer or a copolymer comprising a repeating unit derived from a monomer represented by the following Formula 1 or a phthalic polyester formed by polymerization of phthalic acid and a polyol;

(1)

wherein $R_1$ is a hydrogen atom or an alkyl group having 1 to 12 carbon atoms; $R_2$, $R_3$ and $R_4$ are each a hydrogen atom, an alkyl group having 1 to 12 carbon atoms or a —$COOR_5$ group, $R_5$ a hydrogen atom or an alkyl group having 1 to 12 carbon atoms.

15 Claims, 2 Drawing Sheets

HEAT TRANSFER RECORDING PROCESS USING AN INTERMEDIATE RECORDING SHEET

FIELD OF THE INVENTION

The present invention relates to an image forming process by heat transfer method for recording clearly an image with high resolution even on a secondary image-receiving sheet having low smoothness in a manner wherein an image is recorded temporarily on an intermediate image-receiving sheet and then is re-transferred onto an objective secondary image-receiving sheet.

BACKGROUND OF THE INVENTION

As a heat transfer system, a system of pressing and heating by means of a thermal head has so far been put to practical use, and it has excellent features in the aspects of noiselessness, simple mechanism, maintenance free and dry processing. Furthermore, with regard to image resolution, the density of a thermal head has been enhanced and thereby resolving power of 400–6000 DPI has recently been attained. However, it is difficult to expect further enhancement of density for a thermal head. Thus, there has been a limit of resolving power in conventional heat transfer recording systems.

With the background mentioned above, there has been suggested a laser heat transfer system employing a laser beam as a heat source. In this system, a laser beam can be condensed to about a few microns. Therefore, resolving power can be enhanced remarkably. However, due to high image fineness, image transfer onto a transfer sheet whose surface is highly irregular or wavy is not satisfactory. That is, image resolving power is greatly influenced by how a transfer sheet can be brought into close contact with a sheet.

With regard to contact of a sheet with the surface for exposure in the past, there have been considered some methods wherein a sheet is wound round a drum and both ends of the sheet are pulled to strech it around the drum, or air between the sheet and the drum is sucked to the inside of the drum for vacuum attraction. However, the methods mentioned above alone make it difficult to obtain sufficient close contact between an ink sheet and a transfer sheet. Therefore, sufficient transferability has not been obtained. Further, in order to obtain sufficient vacuum attraction, a method to add fine grains having a particle size of several microns called a matting agent to an image-receiving layer or to an ink layer can be considered. In this method, however, the surface is matted and thereby the close contact is inhibited, resulting in uneven transferring, which has been a problem.

For solving the problem mentioned above, it is effective to cause a transfer sheet or a transfer medium to have cushionlike characteristics for improving the contact condition. However, the method mentioned above is not a fundamental solving means for the so-called rough sheet with the surface having low smoothness because vacuum attraction does not give sufficient pressure.

Therefore, there may be considered a method wherein an image is transferred temporarily onto an intermediate image-receiving sheet having a smooth image-receiving surface and the image is further re-transferred onto an objective image-receiving sheet by means of lamination or the like. In this case, however, a method to transfer an image with an image-receiving layer is relatively easy, but it has a drawback of deterioration of an image grade such as creation of a gloss because of existence of an image-receiving layer on a non-image area on the final image.

The inventors of the present invention found, after studying a method for transferring only an ink image to an objective transfer sheet, that it is possible to transfer an image onto an intermediate image-receiving sheet with sufficient sensitivity by employing tackifer such as rosin in an ink layer and employing a certain kind of thermoplastic elastomer in the intermediate image-receiving sheet and thereby to re-transfer an ink image onto a printing sheet or the like by pressing and heating an image on the intermediate image-receiving sheet.

However, the method mentioned above requires high pressure of at least 20 kg/cm$^2$ or more, and in an ordinary laminator, there occurs dispersion in transferring and ink is transferred from the intermediate image-receiving sheet through cohesive failure, thus, it is difficult to control image density, which is another problem. Therefore, it is desired that almost all ink can be transferred onto a sheet at a laminator pressure of about 2–3 kg/cm$^2$ without deteriorating transfer sensitivity for the intermediate image-receiving sheet.

Methods wherein an image is recorded on an intermediate image-receiving sheet and then the image is pressure-transferred onto any given image-receiving sheet such as a rough sheet or the like are disclosed in Japanese Patent Publication Open to Public Inspection Nos. 127334/1979, 161946/1979, 295094/1986 and 128987/1988 (hereinafter referred to as Japanese Patent O.P.I. Publication). In these methods, however, it has been difficult to form an image with high resolution in the order of several microns corresponding to laser recording, or to re-transfer the image.

SUMMARY OF THE INVENTION

An object of the invention is to provide an image forming process capable of recording clearly an image with high resolution even on an image-receiving sheet having low smoothness through an intermediate image-receiving sheet.

The above object of the invention is attained by a process for image forming by heat transfer method which comprises the steps of transferring an ink image from a ink layer of an ink sheet, which comprises a support and a ink layer provided on the support, to a surface of image receiving layer of an intermediate image receiving sheet, which comprises a support and an image receiving layer provided on the support, by imagewise heating the ink layer re-transferring the ink image transferred on the intermediate image receiving layer to a secondary image receiving sheet, wherein the ink layer comprises a coloring material and a homopolymer or a copolymer comprising a repeating unit derived from a monomer represented by the following formula 1 or a phthalic polyester formed by polymerization of phthalic acid and a polyol;

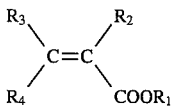

(1)

wherein $R_1$ is a hydrogen atom or an alkyl group having 1 to 12 carbon atoms; $R_2$, $R_3$ and $R_4$ are each a hydrogen atom, an alkyl group having 1 to 12 carbon atoms or a —$COOR_5$ group, $R_5$ is a hydrogen atom or an alkyl group having 1 to 12 carbon atoms. The alkyl group represented by $R_1$ to $R_5$ may be one having straight chain or branched chain.

It is a preferable embodiment of the invention that the polymer mainly comprising a repeating unit derived from a monomer represented by the above formula 1 is a copolymer with styrene.

DETAILED DESCRIPTION OF THE INVENTION

Figure 1A:
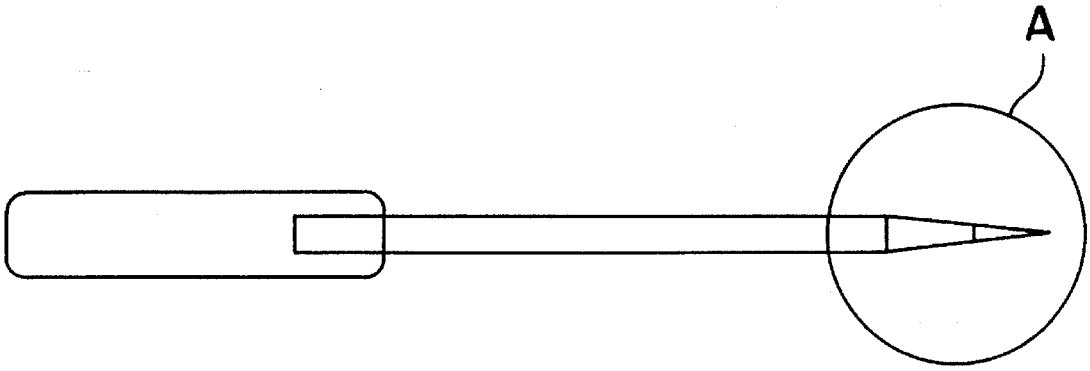
FIG. 1*a* represents shape of a needle used for measuring the penetration of material for a cushion layer.

The invention will be explained more concretely in the order of an ink sheet and an intermediate image-receiving sheet used in the invention.

An ink sheet is basically of a construction wherein heat-fusible ink layer 2 is coated on support 1 and has a function to convert light irradiated on an imagewise basis to heat. In case of need, an intermediate layer such as a releasing layer, a barrier layer or a cushion layer, may be provided between the support and the ink layer.

The heat-fusible ink layer means those capable of being transferred together with a layer containing coloring materials and binders after being fused or softened when heated. It does not need to be transferred under the condition that it is completely fused.

As coloring materials mentioned above, there may be given pigments such as inorganic pigments and organic pigments and dyes.

Inorganic pigments include titanium dioxide, carbon black, zinc oxide, Prussian blue, cadmium sulfide, iron oxide, lead chromate, zinc chromate, barium chromate and potassium chromate.

Organic pigments include pigments of a azo type, a thioindigo type, an anthraquinone type, an anthanthron type and a triphenodioxazine type, vat dye pigments, phthalocyanine pigment, e.g., copper phthalocyanine and its derivative and quinacridone pigments. As an organic dye, acid dye, direct cotton dye, dispersed dye, oil-soluble dye, metal-containing oil-soluble dye and sublimating dye are given.

As the sublimating dye, it is possible to use sublimating dyes which have been known widely in the past. Incidentally, sublimating dyes mentioned in the invention mean heat-sublimating dyes. The sublimating dyes include, for example, cyan dyes, magenta dyes and yellow dyes. A sublimating dye to be contained in an ink layer may be any one of yellow dye, magenta dye and cyan dye when an image to be formed is monochromatic.

A content of coloring materials in an ink layer is usually within a range of 5 to 70% by weight and is preferably within a range of 10 to 60% by weight, though it is not limited in particular.

As a binder in an ink layer, at least one kind of resin selected from the group including homopolymer or copolymer containing monomer represented by Formula (1) mentioned above as a main ingredient and phthalic polyester is used.

Concrete examples of monomers represented by Formula (1) include acrylic acid, methacrylic acid, crotonic acid, α-chloroacrylic acid, maleic acid, fumaric acid and esters derived from the acids mentioned above and alcohol such as methanol, ethanol, n-propanol, iso-propanol, n-butanol, iso-butanol, tert-butanol and straight chain or branched alcohol having from 5 to 12 carbon atoms. As a binder for an ink layer of the invention, homopolymers derived these monomer components or copolymers with monomer components described below are preferably used practically. Monomer components used preferably as copolymer components include, for example, styrene, α-chlorostyrene, vinyl chloride, vinyl acetate, ethylene, propylene, butadiene, vinylpyridine, vinylsulfonic acid ester and vinylidene chloride. Among these monomer components, styrene is especially preferable.

As a copolymer, the one derived from those represented by Formula (1) mentioned above may also be acceptable. Among homopolymers and copolymers mentioned above, those preferably used include a copolymer of acrylic ester and methacrylic ester, a copolymer of styrene and acrylic ester, a copolymer of styrene and methacrylic ester, a copolymer of ethylene and acrylic ester, a copolymer of ethylene and methacrylic ester, a copolymer of acrylic esters being different in type respectively, a copolymer of methacrylic esters being different in type respectively, a copolymer of styrene and maleic acid, a copolymer of styrene and maleic acid half ester, a copolymer of styrene and maleic acid ester, a copolymer of styrene and acrylic acid and a copolymer of styrene and methacrylic acid. Among the foregoing, a copolymer of styrene and monomer represented by Formula (1) is especially preferable.

A composition ratio by weight of a monomer represented by Formula (1) to an other copolymer component in a copolymer is preferably within a range of 20:80–100:0, and a more preferable ratio ranges from 30:70 to 80:20. When monomer components represented by Formula I are contained in the copolymer at a rate of 20% or more, an effect that is sufficiently satisfactory is shown in a re-transfer process.

As a phthalic polyester, a polyester derived from phthalic acid and polyhydric alcohol is given concretely, and more concrete one is a polyester derived from the following polyhyric alcohol such as ethylene glycol, propylene glycol, 1,2-butanediol, 1,4-butanediol, 1,6-hexanediol, bisphenol A and glycerol.

Weight-average molecular weight of a homopolymer or a copolymer mentioned above is preferably within a range of 2000 –400000 and the range of 3000–200000 is more preferable. Its preferable softening point of the polymer measured by a ring and ball method is preferable within a range of 50° C.– 180° C., and the range of 70° C.–150° C. is more preferable. Glass transition temperature of the polymer ranges preferably from 20° C. to 80° C. and it more preferably ranges from 30° C. to 70° C.

It is preferable that the thickness of an ink layer is preferably within a range of 0.2–4.0 μm and the range of 0.3 –2.0 μm is more preferable.

In addition to the above, an ink layer may contain, as additives, fine grains, for example, silica, silicone and acrylic resin each having a particle size of 0.1–3.0 μm, surfactants such as fluorine type surfactant and silicone type surfactant and plasticizers such as dioctylphthalate and zinc stearate. It is preferable that the content of each of the foregoing is not more than 10%. Some 70% by weight or more of the total solid components other than coloring agents in the composition of an ink layer is preferably occupied by the binder components of the invention, and 80% by weight of them contained is more preferalble.

It is preferable that a cushion layer is provided between the ink layer and the support of an ink sheet for the purpose of improving the condition of the close contact between the ink sheet and an image-receiving sheet. However, the support itself may also be provided with the cushion function.

For the cushion layer, the one which is common to that provided preferably on an image-receiving layer is used.

A function for converting light irradiated imagewise to heat can be realized by causing an ink layer to contain photo-thermal conversion materials or by providing a photo-thermal conversion layer containing photo-thermal conversion materials to be adjacent to an ink layer.

As a support, any substance may be used provided that the substance is stable in terms of dimension and can resist heat in the course of image forming. Concretely, a film or a sheet of polythylene pathalate, polycarbonate, nylon, polyethylene naphthalate, polymethyl methacrylate, polyvinyl chloride, polyvinylidene chloride, polystyrene or a cynthetic paper may be used. They are disclosed on 12th–18th lines at the lower part on the left side on page 2 of Japanese Patent O.P.I. Publication No. 193886/1988. Further, in the case of a type wherein a laser beam is irradiated from a side of an ink sheet for image forming, it is preferable that a support for the ink sheet is transparent. When a laser beam is irradiated from a side of an image-receiving sheet for image formation, a support for the ink sheet does not need to be transparent. The thickness of a support is not restricted in particular, it is normally within a range of 2–300 μm, and is preferable within a range of 5–200 μm.

A photo-thermal conversion layer may be provided to be adjacent to an ink layer. As described above, it is also possible to cause an ink layer to contain therein photo-thermal conversion materials. In this case, the photo-thermal conversion layer does not necessarily need to be provided.

When using photo-thermal conversion materials, it is preferable to use a substance that absorbs light and converts it to heat efficiently though the substance depends upon the light source. For example, when a semiconductor laser is used as a light source, a substance having its absorption band in a near infrared zone is preferable. To be concrete, it is possible to use carbon black, graphite, phthalocyanine type dyes, squarium type dyes, nitroso compounds and their metallic complex salts, polymethine type dyes, thiolnickel salts, triarylmethane type dyes, naphthoquinone type dyes, and anthracene type dyes. To be concrete, compounds disclosed in Japanese Patent O.P.I. Publication Nos. 139191/1988 and 103476/1991 are given.

As a binder in a photo-thermal conversion layer, commonly used heat-resistive resins having a high glass transition point and a high thermal conductivity such as, for example, polymethyl methacrylate, polycarbonate, polystyrene, ethylcellulose, nitrocellulose, polyvinylalcohol, polyvinyl chloride, polyamide, polyimide, polyetherimide, polysulfone, polyethersulfone and aramid may be used. A water-soluble or hydrophilic binder, such as gelatin, polyvinylalcohol, methylcellulose, hydroxypropylcellulose, carboxymethylcellulose, hydroxyethylcellulose, polyvinyl pyrrolidone, polyethyleneoxide, polyvinylacetal and polyvinylbutyral, for example, also may be used.

It is preferable that the thickness of the photo-thermal conversion layer is within a range of 0.1–3 μm, and it is possible to determine the content of photo-thermal conversion materials in the photo-thermal conversion layer so that absorbancy at a wavelength of the light source used for image recording may be in a range of 0.3–3.0 normally.

In addition to the foregoing, the photo-thermal conversion layer may also be formed as an evaporated layer, and an evaporated layer of carbon black and that of metal black of gold, silver, aluminum, chromium, nickel, antimony, tellurium, bismuth, and selenium may be given. Incidentally, a photo-thermal conversion material may be a coloring agent itself in an ink layer, or other various substances may be used without being limited to the foregoing.

An image-receiving material (hereinafter referred to as an image-receiving sheet) is composed of support for having thereon at least image-receiving layer 3. It is also possible to provide a cushion layer, a releasing layer, an intermediate layer or an adhesion layer between the support and the image-receiving layer in case of need. Among the layers mentioned above, it is particularly preferable that a cushion layer is provided to obtain the characteristics of re-transferring to a recording sheet.

A support is similar to that used for an ink sheet. When winding an image-receiving material round a drum and overlapping thereon an ink sheet for exposure, the smoothness on the surface of the drum which is not satisfactory causes uneven contact. Therefore, the support is required to have the stiffness at a certain level so that the support may not follow the shape on the drum surface. To be concrete, when a PET film is used as a support, the thickness of 25 μm or more is preferable.

For an image-receiving layer, vinyl chloride grafted ethylene vinyl acetate copolymer (EVA), EVA grafted polyvinyl chloride, polyvinylacetal, polyvinyl butyral, polyvinylformal, polybutadiene resin, and copolymers such as styrene/acryl copolymer, vinyl chloride/acryl copolymer, vinyl chloride/ethylene/vinyl acetate copolymer and vinyl chloride/ethylene copolymer may be exemplified.

Among the foregoing, vinyl chloride grafted EVA, EVA grafted polyvinyl chloride, polyvinylacetal and polyvinylbutyral are especially preferable. It is preferable that glass transition temperature of the binder for an image-receiving layer is within a range from −20° C. to 100° C. Further, the preferable softening point is within 60° C. – 150° C. With regard to molecular weight, it is not restricted in particular, but weight-average molecular weight of 2000 is preferable.

Vinyl chloride grafted EVA or EVA grafted polyvinyl chloride is a three-component copolymer of vinylchloride monomer, ethylene and vinylacetate monomer. It is preferable that composition of each monomer ranges from 10% by weight to by weight.

Polyvinylacetal and polyvinylbutyral are represented by the following foumula

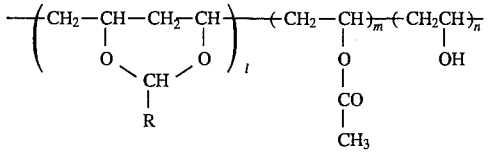

and a preferable composition ratio thereof is 50–99% by weight for components of acetal or butyral, 1–40% by weight for component of vinylacetate and 1–40% by weight for component of vinyl alcohol, to which the invention is not limited.

The preferable thickness of an image-receiving layer is within a range of 0.1–10 μm, and more preferable thickness thereof is in the range of 0.2–3 μm. It is preferable that an amount of polymers of the invention to be contained in an image-receiving layer is 50% by weight or more, and it is more preferable that the amount thereof is 70% or more. As other components to be contained in an image-receiving layer, components to be contained in the ink layer mentioned above, especially binder components can be contained. As a coating method for an image-receiving layer, it is possible to use a method which is the same as that for a cushion layer of a recording material.

It is preferable that binders in an image-receiving layer contain polymers which are the same in terms of kind as polymers used in an ink layer together with these resins. Namely, homopolymers or copolymers formed with primary component of monomers represented by the Formula 1 mentioned above or they contain polyester resins formed derived from phthalic acid and polyol. Accordingly, when an ink layer contains homopolymers or copolymers formed with monomers represented by the aforementioned formula 1 as the primary ingredients, an image-receiving layer also contains homopolymers or copolymers formed with monomers represented by the aforementioned formula 1 as the primary ingredients, and when an ink layer contains polyester resins, an image-receiving layer also contains polyester resins. When polymers are the same in terms of kind, composition and physical properties of polymers contained in an ink layer do not need to be the same as those of polymers contained in an image-receiving layer.

Concrete examples of polymers include styrene-acrylic acid ester copolymer, styrene-methacrylic acid ester copolymer, styrene-maleic acid copolymer, styrene-maleic acid half-ester copolymer, styrene-maleic acid ester copolymer, polyester of phthalic acid and ethylene glycol and polyester of phthalic acid and alkyldiol having 4 or more carbon atoms. For polymers mentioned above, weight-average molecular weight ranges preferably from 3000 to 150000, softening point measured by a ring and ball method is preferably within 60° C.–180° C., more preferable softening point is within 80° C.– 150° C. and more preferable glass transition temperature is within 30° C.–100° C., which means that polymers whose molecular weight is higher than that of one used for binders in an ink layer are preferable. It is preferable that the image-receiving layer contains a polymer the same in terms of kind as that contained in the ink layer at the rate of 0 to 60% by weight of the total polymers forming the image-receiving layer, and the rate of 10 to 50% by weight is more preferable.

When polymers of the same in terms of kind contained in both the ink layer and the image-receiving layer are those comprising a component derived from a monomer represented by Formula 1, it is preferable that the component of component derived from a monomer of Formula 1 represents the main component of the polymer in both polymers in both layer, namely the component derived from the monomers occupies the greatest weight percent of the polymer. It is preferable that 50% by weight or more of the polymer is occupied by the component of derived from the monomer. It is further preferable that a difference between the weight percent of the component derived from the monomer represented by Formula 1 in the polymer contained in the ink layer and that in the polymer contained in the image-receiving layer is not more than 20%, and the difference of 10% or less is more preferable.

With regard to physical properties of components of binders used for an ink layer and an image-receiving layer, it is preferable that Tg of a binder that has a monomer component the same as that used in an ink layer and added to the image-receiving layer is higher by 30° C. or more than that of a binder that is used in the ink layer and the softening point is higher by 60° C.

In addition to the foregoing, it is also possible to add surface active agents, antistatic agents, matting agents and plasticizers to the image-receiving layer.

A support for an image-receiving layer can take any substance provided that the substance is stable in dimensions and is heat-resisting in the course of image formation. Concrete examples which can be used are the same as those for the forementioned those for ink sheet. When forming images by irradiating a laser beam from a side of an image-receiving sheet, it is preferable that a support for an image-receiving sheet is transparent.

As in the case of an ink sheet, an image-receiving sheet is preferably provided with a cushion layer for the purpose of improving the condition of close contact between an image-receiving sheet, an ink sheet and secondary image-receiving sheet 5. However, the support itself mentioned above may be provided with cushionlike characteristics.

A cushion layer provided on an ink sheet or on an image-receiving sheet has a function to improve the close contact between the ink sheet and the image-receiving sheet, and it plays an important part when re-transferring, by means of laminating or the like, a formed image to a secondary image-receiving sheet such as a sheet of paper. Namely, the cushion layer has a function to cause an image to be brought into close contact with the surface of a sheet whose smoothness is low. When re-transferring, how an image surface fits the surface of a sheet is important. For the sheet having low smoothness, therefore, it is preferable that an image-receiving sheet has sufficient cushionlike characteristics or heat-softening characteristics.

For the purpose of giving cushionlike characteristics to either an image-receiving sheet or an ink sheet, any of materials such as a material having the low modulus of elasticity, a material having rubber elasticity and a thermoplastic material which can be softened by heating easily and thereby be improved in characteristics for the close contact. In some cases, foreign materials such as dust existing between an ink sheet and an image-forming sheet cause problems of transfer failure. In order to lessen the problems, it is especially preferable to use a material having high penetration, which makes it easy to transfer images because foreign materials sink in the cushion layer.

Figure 1B:
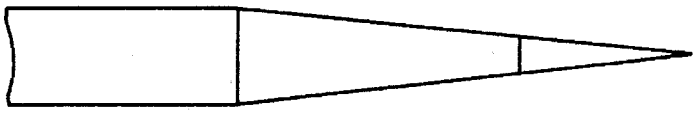
FIG. 1*b* is magnified drawing of Part A of FIG. 1. In the figures, d represents diameter.
Figure 2A:
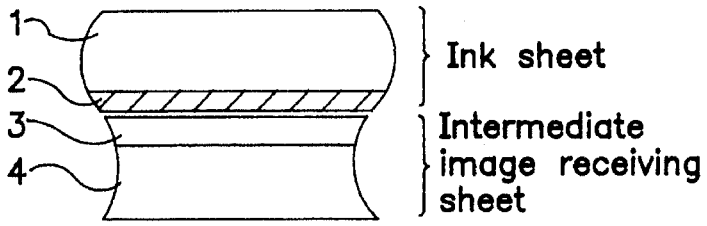
FIGS. 2*a* to 2*e* illustrate the operation of the inventive method.
Figure 2B:
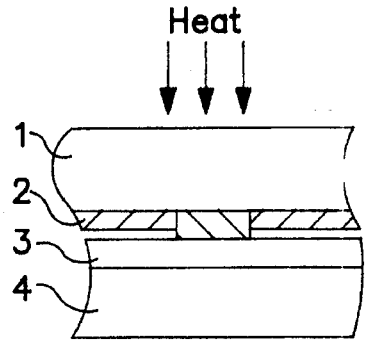
Figure 2C:
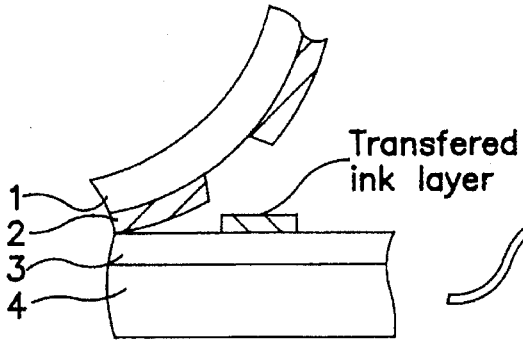
Figure 2D:
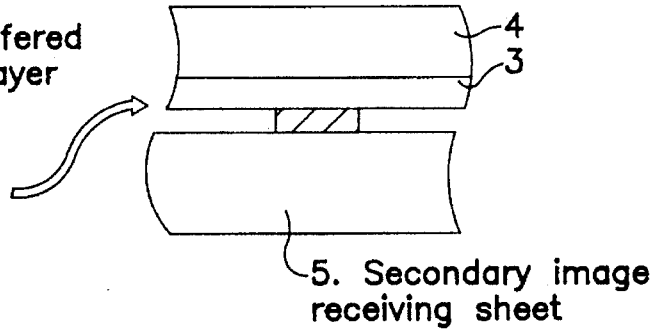
Figure 2E:
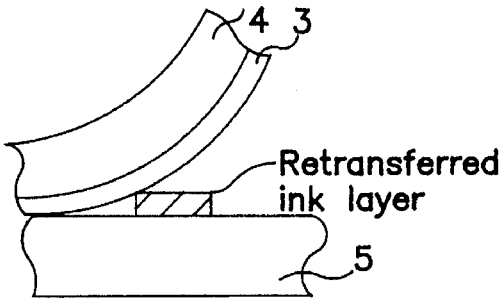

The penetration is measured by a method similar to that applied for measuring the penetration degree of petroleum asphalt. In the method a metal needle having a specified dimensions shown in FIGS. 1*a* and 1*b* is used. To the surface of a block of the material for cushion layer, the needle is perpendicularly touched at the point of it with no loading. Then a load of 100 gram is added to the needle. After standing for 5 minutes, sinking distance of the needle caused by the loading is measured by a dial gauge equipped with the needle. During the measurement, the temperature of the sample is maintained at 25° C. The penetration degree is expressed by a value of ten times of the sinking distance by mm, for instance, the penetration is expressed as 1 when the sinking distance is 0.1 mm. Concerning the detail of measuring apparatus, JIS K 2530 and JIS K 2808 can be referred.

Concretely, there may be given resins having high penetration among those including natural rubber, acrylate rubber, butyl rubber, nitrile rubber, butadiene rubber, isoprene rubber, styrene-butadiene rubber, chloroprene rubber, urethane rubber, silicone rubber, acrylic rubber, fluorine-contained rubber, neoprene rubber, chlorosulfonic polyethylene, epichlorohydrin, EPDM (ethylene-propylene-diene rubber), elastomer such as urethane elastomer, polyethylene, polypropylene, polybutadiene, polybutene, shock-proof ABS resin, polyurethane, ABS resin, acetate, cellulose acetate, amide resin, polytetrafluoroethylene, nitrocellulose, polystyrene, epoxy resin, phenolformaldehyde resin, polyester, shock-proof acrylic resin, styrene-butadiene copolymer, ethylene-vinyl acetate copolymer, acrylonitrile-butadiene copolymer, vinyl chloride-vinyl acetate copolymer, polyvinyl acetate, plasticizer-contained vinyl chloride resin, vinylidene chloride resin, polyvinyl chloride, and polyvinylidene chloride. For the purpose of obtaining high penetration, it is also possible to add plasticizers to the various polymers mentioned above.

Considering satisfactory close contact between a cushion layer and an ink sheet under the vacuum contact, it is preferable that the penetration of the cushion layer at room temperature (25° C.) is not less than 15, and it is more preferable to be 30 or more.

As a material having high penetration, ethylene vinylacetate copolymer (EVA) (VA is 30% or more), styrene-isoprene-styrene block copolymer having rubber ratio of 70% or more and similar olefin type resins (ethylene-ethylacrlylate copolymer (EEA), ethylene-acrylic acid copolymer (EAA), ethylene-methylacrylate copolymer (EMA), ionomer, styrene-isoprene-styrene block copolymer (SIS), styrene-butadiene-styrene block copolymer (SBS), styrene-ethylene-butadiene-styrene block copolymer (SEBS)) may be given.

The thickness of a cushion layer can not be determined unconditionally because it depends on various factors such as types of resins or elastomers to be used, attraction force in the close contact between an ink sheet and an image-receiving sheet, surface smoothness of a secondary image-receiving sheet for image re-transferring, and whether matting agents are used or not.

As a method for forming a cushion layer, a coating method wherein a solution of the materials described above dissolved in a solvent or dispersed in a form of a latex is coated by means of a blade coater, a roll coater, a bar coater, a curtain coater or a gravure coater, a method of hot melt extrusion lamination and a method for pasting a cushion layer and a film together may be used.

The thickness of a cushion layer is not less than 10 μm, and it is preferably 15 μm to 100 μm. A cushion layer may also be of a two-layer construction for satisfying the surface smoothness described later.

For heat transfer from an ink sheet to an image-receiving sheet, surface smoothness (surface roughness or waviness) of the image-receiving sheet is important. To be concrete, it is preferable that the surface roughness Ra is not more than 0.5 μm when the roughness is measured with a standard length is 2.5 mm and cutoff value is 0.08 mm, and, Rmax is not more than 3 μm when a standard length is 2.5 mm and cutoff value is 8 mm.

EXAMPLE

Example 1

(Preparation of an ink sheet)

A photo-thermal conversion layer and an ink layer both having the following compositions respectively were coated in succession on a base composed of a 75 μm-thick transparent PET (polyethyleneterephthalate made by Diafoil Hoechst, T-100) having thereon a laminate-coated 30 μm-thick EVA (made by Du Pont-Mitsui Polychemical Company Ltd., P1407C, penetration 7) for preparing an ink sheet. For obtaining surface accuracy in the course of the laminate-coating, a 25 μm-thick PET film was used to be pasted, and the 25 μm-thick PET film was peeled off before coating of the photo-thermal conversion layer. The surface accuracy on the surface of EVA in terms of Ra was 0.5 μm.

Incidentally, the wording of "parts" used in examples represents parts by weight of solid materials.

| Photo-thermal conversion layer | |
|---|---|
| PVA (polyvinylalcohol made by Clare, C506) | 3.5 parts |
| IR absorbing dye (Compound IR-1) | 3.4 parts |
| Surface active agent (FT248 made by BASF) | 0.1 parts |
| Water | 93.0 parts |

The foregoing was coated so that absorbancy for light with a wavelength of 830 nm may be 1.0. The thickness of dry coating was about 0.25 μm.

IR-1

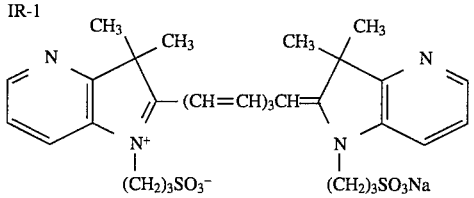

| Ink layer | |
|---|---|
| Magenta pigment methyl ethyl ketone (MEK) dispersion | 25 parts |
| Styrene/acrylic resin (made by BASF, Suprapal WS, softening point 135–145° C.) | 62 parts |
| EVA (made by Du Pont-Mitsui Polychemical Company Ltd., EV40Y) | 5 parts |
| DOP (dioctylphthalate) | 3 parts |
| Paraffin wax MEK diopersion (made by Tokyo Ink, FWO20) | 5 parts |
| MEK | 90 parts |

The foregoing was coated to be 0.7 μm in thickness of dry coating.

In the above and herein after Styrene/acrilic resin Suprapal WS is a polymer of styrene and a monomer of Formula 1 of the invention, in which $R_3$ and $R_4$ are each a hydrogen atoms.

(Preparation of an image-receiving sheet)

On the base wherein EVA (described above, P1407C) was laminated to be 30 μm in thickness on a 75-μm-thick transparent PET (described above, T-100), the solution wherein 1,2-polybutadiene (made by Nihon Synthetic Rubber, RB 830) having softening point of 68° C. was dissolved in toluene was coated to be an image-receiving layer having the thickness of dry coating of 1 μm, thus, an image-receiving sheet was prepared.

(Thermal transfer)

The ink sheet and the image-receiving sheet were wound round a drum with an ink layer of the ink sheet and an image-receiving layer of the image-receiving sheet both caused to face each other to be brought into close contact with each other under vacuum condition of 400 Torr, and they were subjected to exposure by means of a semiconductor laser with oscillation wavelength of 830 nm under the condition of 60 mW at an irradiation point. An image of dots each having a size of 5 μm obtained through the exposure was transferred thoroughly at the sensitivity of 1.5 mJ/mm$^2$. The image thus obtained was caused to face a printing sheet art paper, to be re-transferred thereon through a laminater available on the market which was adjusted to the conditions of temperature of 140° C. and pressure of 2 kg/cm$^2$. As a result, 96% of ink on the image-receiving layer was re-transferred onto the printing sheet in the state of interface peeling. The value obtained by dividing the transmission density of ink remaining on the image-receiving layer with the transmission density of ink transmitted first from the ink layer was used to express the state of re-transfer.

Further nine kinds of samples of ink sheets were prepared in the same manner as in the above mentioned ink sheet except that Suprapal WS of the ink layer was replaced with the following inventive binders in each samples. Re-transfer tests were conducted used these samples in the same manner as in the foregoing test. The binders used and the results therefrom are as follows. In the followings, Ts is softening point, Tg is glass transition point, mp is melting point and Mw is molecular weight.

| Binders | Sensitivity ($mJ/mm^2$) | Re-transfer rate |
|---|---|---|
| Phthalic polyester resin, (Phtalopal PP made by BASF) Ts = 90–105° C. | 3 | 97% |
| Phthalic polyester resin, (Phtalopal NP made by BASF) Ts = 80–90° C. | 3 | 95% |
| Styrene/acryl resin (Polystyrene butyl methacrylate, Hymer SBM73F made by Sanyo Chemical Industries) Tg = 60° C., Ts =120° C., Mw ≈ 35,000 | 1 | 98% |
| Styrene/acryl resin (Polystyrene butyl methacrylate, Hymer SBM1000 made by Sanyo Chemical Industries) Tg = 50° C., Ts = 104° C., Mw ≈ 20,000 | 1 | 99% |
| Modified styrene/maleic anhydried resin (SMA1440A, made by Fum Tsusho) Styrene; maleic anhyd. = 1:1 mp = 55–75° C., Mw ≈ 2,500 | 1 | 99% |
| Modified styrene/maleic anhydried resin (SMA3840A, made by Fujii Tsusho) Styrene;maleic anhyd. = 3:1 mp = 100–120° C., Mw ≈ 2,300 | 1 | 95% |
| Styrene/maleic acid half ester resin (Oxylac SH-2018, made by Nihon Shyokubai) | 1 | 96% |

The ink sheet in Example 1 using styrene/acrylic resin: WS, was used for an ink sheet and the following were used as an image-receiving sheet to make evaluation.

(Preparation of image-receiving sheet)

An adhesive anchor layer was provided on a 75 μm-thick transparent PET film (described before, T-100) and a 1,2-polybutadiene film sheet (made by Nihon Synthetic Rubber, MELBAG) was laminated thereon. Accuracy for forming the image-receiving sheet was not more than ±1 μm. Since the 1,2-polybutadiene film sheet contains lubricants and thereby has sliding properties, no blocking takes place even when films are superposed. However, the surface smoothness of the film sheet is not sufficient when no action is taken on the film sheet.

Therefore, the surface of the image-receiving layer of the image-receiving sheet mentioned above was caused to face a PET film having high surface smoothness, and then was laminated at a temperature of 120° C. This causes the image-receiving surface to be smooth. Immediately after peeling off the PET film, transfer of ink and re-transfer thereof onto a sheet of paper were conducted in the same manner as in Example 1. Sensitivity of transfer to the image-receiving sheet and re-transfer rate were excellent, similarly to Example 1.

Example 3

The first one in Example 1 was used for an ink sheet and the following were used as an image-receiving sheet to make evaluation. The image-receiving layer was formed through coating of various solvents or dispersed products so that the thickness of dried coating of 1 μm may be obtained.

| Image-receiving layer materials |
|---|
| A: Vinyl chloride grafted ethylene-vinyl acetate copolymer (made by Sekisui Chemical Co., Ltd., ESMEDICA V1330E) |
| B; Vinyl chloride grafted ethylene-vinyl acetate copolymer (made by Shin-Ets Chemical Co., Ltd., TK2500) Tg = 80° C., Mn = 2500 |
| C: Vinyl chloride grafted ethylene-vinyl acetate copolymer (made by Nippon Zeon Co., Ltd., Graftmer-R3) |
| D: Ethylene-vinyl acetate copolymer (made by Du Pont-Mitsui Polychemical Company Ltd., EV250) Tg = −20° C. |
| E: Urethane grafted ethylene acrylic acid copolymer aqueous dispersion (made by TOHO Chemical Industry Co., Ltd., S8533) Tg = −25° C. |
| F: Vinyl chloride type grafted ethylene-vinyl acetate copolymer (made by Sekisui Chemical Co., Ltd., ESMEDICA N3132E) PVC/EVA graft copolymer |

The results of re-transfer were as follows.

| | Results | |
|---|---|---|
| | Sensitivity ($mJ/mm^2$) | Re-transfer rate |
| A | 2.0 | 98% |
| B | 2.0 | 96% |
| C | 2.0 | 99% |
| D | 3.0 | 94% |
| E | 3.0 | 93% |
| F | 2.0 | 98% |

Comparative Example 1

Among prescriptions for the ink layer used in Example 1, styrene/acrylic resin (made by BASF, Suprapal WS) was replaced by rosin type tackifier (made by Harima Chemical, Inc., DS90), phenol resin (made by Arakawa Kagaku Kogyo Kabushiki Kaisha, Tamanol 510) and to polystyrene (made by Sanyo Chemical Industries, Ltd. SB-75). In this case, clear transfer to an image-receiving sheet was observed, but in re-transfer in a laminater similar to that used in Example 1, ink suffered cohesive failure and only a part of ink was transferred, thus, re-transfer to paper was not successful. The results thereof are as follows.

| | Results | |
|---|---|---|
| Resin | Sensitivity ($mJ/mm^2$) | Re-transfer rate |
| DS90 | 2.5 | 45% |
| Tamanol 510 | 3.0 | 52% |
| SB-75 | 2.5 | 67% |

Example 4

Ink sheets and image-receiving sheets were prepared by changing binders in ink layers or image-receiving layers in Example 1 to the following.

(Ink sheet)

Styrene/acrylic resins in binders in ink layers were changed to the following.

A. Styrene/acrylic resin (made by Sanyo Chemical Industries, Ltd., Hymer SBM73F) Tg=60° C., softening point 120° C., Mw= 35,000

B. Styrene/acrylic resin (made by Sanyo Chemical Industries, Ltd., Hymer TB1000) Tg=58° C., softening point 145° C., Mw= 300,000

(Image-receiving sheet)

Vinyl chloride grafted ethylene-vinyl acetate copolymer in binders in image-receiving layers were changed to the following.

A. Vinyl chloride/EVA graft copolymer (made by Sekisui Chemical Co., Ltd., ESMEDICA V1330E B. Polyvinylbutyral resin (made by Denki-Kagaku Kogyo Kabushiki Kaisha, DENKA 6000A) polymerization degree 2400

C. Polyvinylbutyral resin (made by Denki-Kagaku Kogyo Kabushiki Kaisha, DENKA 5000A) polymerization degree 2000

D. Hymer SBM100/graftmerE=6/4

Results are shown below.

TABLE 1

| | Ink sheet A | | Ink sheet B | |
|---|---|---|---|---|
| Image-receiving sheet | Sensitivity | Transfer rate | Sensitivity | Transfer rate |
| A (Invention) | 200 mJ/cm$^2$ | 97% | 200 mJ/cm$^2$ | 98% |
| B (Invention) | 190 mJ/cm$^2$ | 94% | 190 mJ/cm$^2$ | 95% |
| C (Invention) | 190 mJ/cm$^2$ | 95% | 190 mJ/cm$^2$ | 95% |
| D (Invention) | 180 mJ/cm$^2$ | 100% | 180 mJ/cm$^2$ | 100% |

Image-receiving sheet D is one wherein binder component identical to that in an ink sheet in terms of type was added also to an image-receiving layer. In this case, retransfer was excellent showing that 100% of ink was transferred, and transferred ink was glossy.

Example 5

(Preparation of ink sheet)

An ink sheet was prepared. After SEBS (made by Shell: KRATON G1657) and Tackifier (made by Arakawa Kagaku Kogyo Kabushiki Kaisha, Super Ester A100) were dissolved in toluene at their weight ratio of 70:30, they were coated on a 75 μm-thick transparent PET film (polyethylenetelephthalate, Diafoil-Hoechst: T-100) with a wire bar to realize the thickness of dried coating of 20 μm. On this layer, a photo-thermal conversion layer and an ink layer both shown below were coated in succession to form an ink sheet. Penetration of the cushion layer composed of SEBS and tackifier was 19.1 which is a standard condition in JIS K 2530.

| Photo-thermal conversion layer | |
|---|---|
| Gelatin | 3.38 parts |
| Citric acid | 0.02 parts |
| Surfactant (Compound 1) | 0.05 parts |
| Glyoxal | 0.02 parts |
| IR-absorption dye (Compound IR-2) | 1.4 parts |
| Sodium acetate | 0.13 parts |
| Distilled water | 90 parts |
| Ethanol | 5 parts |

The foregoing was coated so that the absorbancy for light having a wavelength of 830 nm may show 1.0. The layer thickness was 0.3 μm.

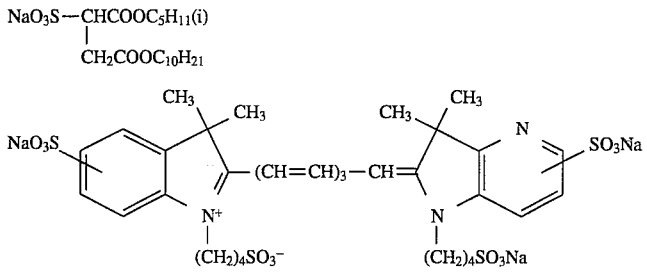

Compound 1

Compound IR-2

λmax 752nm (in MEOH)

| Ink layer | |
|---|---|
| Magenta dye MEK dispersed product | 40 parts |
| Styrene-acrylic resin (made by Sanyo Chemical Industries, Ltd.: Hymer SMB100, softening point 104° C., Tg = 50° C.) | 48 parts |
| Ethylene-vinyl acetate copolymer resin (made by Du Pont-Mitsui Polychemical Company Ltd.: EV40Y) | 5 parts |
| Silicone resin particle (made by Toshiba Silicone, Tospal 108) | 1 part |
| MEK (methyl ethyl ketone) | 80 parts |
| Cyclohexanone | 10 parts |

Coating was conducted so that the thickness of dried coating of 0.6 μm may be obtained.

(Preparation of image-receiving sheet)

Cushion layer CL was prepared by coating EVA dissolved in toluene on 100 μm-thick PET film support $S_1$ subjected to antistatic treatment so that the thickness of dried coating of 20 μm was obtained.

In addition, a base having thereon 5 μm-thick image-receiving layer was prepared by coating polymer dissolved in toluene on 25 μm-thick PET film subjected to silicon treatment for improvement of releasing properties.

The base coated with the image-receiving layer was pasted on the support coated with the cushion layer at room temperature in a manner that the cushion layer and the image-receiving layer face each other, and releasing PET film was peeled off. Thus, the image-receiving sheet wherein the cushion layer and the image-receiving layer are stacked on the support $S_1$ was obtained. In this method, it is possible to provide an image-receiving layer without dissolving a cushion layer. Six types of image-receiving sheets shown below were prepared by changing materials of the cushion layer and the image-receiving layer.

| Image-receiving layer | Cushion layer | Image-receiving layer composition |
|---|---|---|
| 1 | EVA (VA40%) | Graftmer E/Hymer TB1000 (40/60) |
| 2 | EVA (VA40%) | EVA (VA15%) |
| 3 | EVA (VA40%) | EVA (VA15%)/Graftmer E (20/80) |
| 4 | EVA (VA10%) | Graftmer E/Hymer SBM100 (40/60) |
| 5 | None | Graftmer E |
| 6 | EVA (VA40%) | Ryuron QC-640 |

Incidentally, penetration of the cussion layer of EVA (VA10%) and that of EVA (VA40%) were 15 and 40 respectively. Polymers used for preparation of the above-mentioned samples are as follows.

Graftmer E (made by Nippon Zeon Co., Ltd.: vinyl chloride/EVA graft copolymer)

Hymer TB1000 (made by Sanyo Chemical Industries, Ltd.: styrene acrylic resin, softening point 145° C., Tg=58° C.)

Hymer QC-640 (made by TOSO Co.: vinyl chloride-vinyl propionate copolymer)

Tg=52° C., Ts=57° C., polymerization degree approx. 220

(Thermal transfer)

The aforementioned ink sheet and image-receiving sheet were wound round a drum with their faces facing each other to be brought into close contact with each other under vacuum condition of 400 Torr, and they were subjected to exposure by means of a semiconductor laser with oscillation wavelength of 830 nm under the condition of 33 mW at an irradiation point and a beam diameter of 6 μm. As a result, the transfer was conducted thoroughly at the sensitivity of 200 mJ/cm$^2$ without any scratch and blurring. The image thus obtained was caused to face a printing sheet (Mitsubishi Tokuryo Art Paper) to be re-transferred thereon through a laminator available on the market which was adjusted to the conditions of temperature of 150° C. and pressure of 2 kg/cm$^2$. As a result, only ink on the image-receiving layer was re-transferred at the rate of approximately 100% without any paper peeling. Other image-receiving sheets were also subjected to the same thermal transfer.

Sensitivity, re-transferring properties and blocking properties of each image-receiving sheet are shown below.

| Image-receiving sheet | Sensitivity (mJ/cm$^2$) | Re-transfer properties | Blocking |
|---|---|---|---|
| 1 | 200 | 100% | None at all |
| 2 | 220 | 92% | Existing slightly |
| 3 | 220 | 97% | None at all |
| 4 | 210 | 100% | None at all |
| 5 | 200 | 75%*1 | None at all |
| 6 | 240 | 82%*2 | Existing |

*1On the image-receiving sheet No. 5, a cushion layer was not provided on the image-receiving sheet at all. In the course of re-transferring, therefore, ink was not brought into close contact with paper, and re-transfer of ink to paper was limited to 75–82%.

*2Non-image areas were fused and stuck to paper to cause paper peeling.

On image-receiving sheets No. 1 and No. 4, sensitivity was slightly high and excellent re-transfer properties were obtained because polymers in binders for the image-receiving layer were the same as those in binders for the ink sheet.

The foregoing shows that when an image-receiving sheet contains the same polymers as those in an ink sheet, an excellent effect can be obtained, and when it is provided with a cushion layer having high penetration, the effect can be enhanced.

What is claimed is:

1. A process for forming an image by heat transfer, said process comprising:

imagewise transferring an ink layer from an ink sheet, said ink sheet comprising a support having provided thereon a heat-fusible ink layer, onto a surface of an intermediate image receiving layer on an intermediate image receiving sheet by imagewise heating said heat-fusible ink layer, and retransferring said ink layer imagewise transferred onto said intermediate image receiving layer, to a secondary image receiving sheet, wherein said heat-fusible ink layer comprises a coloring material and a homopolymer or copolymer comprising a repeating unit derived from a monomer represented by Formula 1, or a phthalic polyester formed by polymerization of phthalic acid and a polyol,

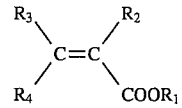

(1)

wherein $R_1$ is hydrogen or alkyl having 1 to 12 carbon atoms; $R_2$, $R_3$ and $R_4$ are each hydrogen, alkyl having 1 to 12 carbon atoms or —$COOR_5$, and $R_5$ is hydrogen or alkyl having 1 to 12 carbon atoms.

2. The process of claim 1, wherein said ink layer comprises a copolymer derived from a monomer component represented by Formula 1 and styrene or a phthalic polyester resin derived from phthalic acid and a polyol compound.

3. The process of claim 2, wherein said ink layer comprises a copolymer derived from a monomer component represented by Formula 1 and styrene.

4. The process of claim 1, wherein said homopolymer or copolymer comprising a repeating unit derived from a monomer represented by Formula 1 or said phthalic polyester has a softening point within the range of 50° C. to 180° C.

5. The process of claim 4, wherein said homopolymer or copolymer comprising a repeating unit derived from a monomer represented by Formula 1 or said phthalic polyester has a softening point within the range of 70° C. to 150° C.

6. The process of claim 1, wherein said ink sheet further has a cushion layer between said support and said ink layer.

7. The process of claim 1, wherein said intermediate image receiving layer comprises a polymer selected from the group consisting of a vinyl chloride-grafted ethylene/vinyl acetate copolymer, an ethylene/vinyl acetate-grafted polyvinyl chloride, a polyvinylacetal, a polyvinylbutyral, a polyvinylformal, a styrene/acrylate copolymer, a vinyl chloride/acrylate copolymer, a vinyl chloride/ethylene/vinyl acetate copolymer and a vinyl chloride/ethylene copolymer.

8. The process of claim 7, wherein said polymer of the image receiving layer has a softening point of from 60° C. to 180° C.

9. The process of claim 7, wherein said polymer of the image receiving layer has a softening point of from 80° C. to 150° C.

10. The process of claim 7, wherein said image receiving layer of the intermediate image receiving sheet further comprises a homopolymer or a copolymer comprising a repeating unit derived from a monomer represented by formula 1, when said ink layer comprises a homopolymer or a copolymer comprising a repeating unit derived from a monomer represented by formula 1, or a phthalic polyester resin, when said ink layer comprises a phthalic polyester resin.

11. The process of claim 7, both of said ink layer and said image receiving layer of the intermediate image receiving sheet each comprises a copolymer derived from a monomer component represented by Formula 1 and styrene.

12. The process of claim 1, wherein said image receiving layer of the intermediate image receiving sheet has a thickness of 0.1 μm to 10 μm.

13. The process of claim 12, wherein said image receiving layer of the intermediate image receiving sheet has a thickness of 0.2 μm to 3 μm.

14. The process of claim 1, wherein said intermediate image receiving sheet further has a cushion layer provided between said support and said image receiving layer.

15. The process of claim 14, wherein said cushion layer comprises a thermoplastic polymer having a penetration of not less than 15 measured at 25° C. and has a thickness of not less than 10 μm.

* * * * *